US008740327B2

(12) United States Patent
Iwata et al.

(10) Patent No.: US 8,740,327 B2
(45) Date of Patent: Jun. 3, 2014

(54) INKJET RECORDING APPARATUS AND METHOD FOR CLEANING CARRIAGE

(71) Applicant: Canon Kabushiki Kaisha, Tokyo (JP)

(72) Inventors: Naohiro Iwata, Yokohama (JP); Seiji Ogasawara, Machida (JP); Hideaki Nagahara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 13/655,314

(22) Filed: Oct. 18, 2012

(65) Prior Publication Data

US 2013/0100184 A1 Apr. 25, 2013

(30) Foreign Application Priority Data

Oct. 20, 2011 (JP) ..... 2011-230663

(51) Int. Cl.
*B41J 25/308* (2006.01)
*B41J 11/20* (2006.01)

(52) U.S. Cl.
USPC ..... 347/8; 400/59

(58) Field of Classification Search
USPC ..... 347/5, 8, 20, 22; 400/59, 60
See application file for complete search history.

(56) References Cited

U.S. PATENT DOCUMENTS 5,975,666 A * 11/1999 Kawaguchi ..... 347/8
7,850,300 B2 * 12/2010 Hiroki et al. ..... 347/104
8,147,059 B2 * 4/2012 Miyata ..... 347/104

FOREIGN PATENT DOCUMENTS

JP 2006-192698 A 7/2006

* cited by examiner

*Primary Examiner* — Anh T. N. Vo
(74) *Attorney, Agent, or Firm* — Canon USA Inc. IP Division

(57) ABSTRACT

A method for cleaning a carriage of an inkjet recording apparatus including a recording head configured to discharge ink to execute recording on a sheet, a conveyance unit configured to convey the sheet, a carriage configured to mount the recording head thereon and to move in a main-scanning direction crossing to a sheet conveyance direction, and a height change mechanism configured to move the carriage in a height direction includes moving the carriage in the main-scanning direction to the outside of a sheet conveyance area of the conveyance unit, conveying a cleaning sheet, to which a fold is previously given, to a recording position, moving the carriage to a first height position via the height change mechanism, moving the carriage to the inside of the sheet conveyance area, moving the carriage to a second height position via the height change mechanism, and conveying the cleaning sheet via the conveyance unit.

9 Claims, 12 Drawing Sheets

INKJET RECORDING APPARATUS AND METHOD FOR CLEANING CARRIAGE

BACKGROUND OF THE INVENTION

1. Field of the Invention

The present invention relates to an inkjet recording apparatus causing a recording head to discharge ink to a recording material to execute recording, and relates to a method for cleaning a carriage in the inkjet recording apparatus.

2. Description of the Related Art

To obtain clear and high-quality recording results from an inkjet recording apparatus, it is important to decrease the distance between a recording material and a recording head. However, if the distance between the recording material and the recording head is decreased, for example, when a paper jam is caused and the recording material contacts the recording head, the recording head may be damaged. To respond to the problem, some inkjet recording apparatuses include head protection members for protecting ends of the recording head. The head protection members are arranged near both sides of the recording head in the main-scanning direction of the carriage including the recording head.

However, in recent years, inkjet recording apparatuses have been faced with a problem, with a decrease in the size of each ink droplet discharged to the recording material and with an increase in the density of discharge ports. More specifically, when ink is discharged, instead of reaching the recording material, a generated ink mist floats inside the recording apparatus and soils the inside of the recording apparatus. In addition, the ink mist soils the head protection members, which soil the recording material.

Japanese Patent Application Laid-Open No. 2006-192698 discusses a technique for cleaning the head protection members of a carriage. According to the technique, a wiper unit cleans a face surface of the recording head. However, the configuration discussed in Japanese Patent Application Laid-Open No. 2006-192698 involves the following problems. Generally, a wiper member for cleaning a face surface of a recording head is arranged outside the recording material conveyance area in a main-scanning direction (the width direction of the apparatus body). Thus, when the carriage is moved from inside the recording material conveyance area to a position where the carriage faces the wiper member, a positional relationship among the face surface of the recording head, the head protection members, and the wiper member changes as follows.

When the carriage is moved in the main-scanning direction, first, one of the head protection members that is closer to the wiper member faces the wiper member. When the carriage is moved further, the face surface of the recording head faces the wiper member. When the carriage is moved yet further, the head protection member that is further from the wiper member faces the wiper member. Thus, to clean the head protection member that is further from the wiper member, the carriage needs to be moved further than the recording head face surface cleaning position in the width direction of the apparatus body. As a result, the size of the recording apparatus body is increased in the width direction.

In addition, according to the configuration discussed in Japanese Patent Application Laid-Open No. 2006-192698, since the wiper member cleans the face surface of the recording head and the head protection members, durability including the performance for cleaning the head protection members needs to be assured.

SUMMARY OF THE INVENTION

The present invention is directed to a method for cleaning a carriage, in which ink attached to head protection members of the carriage can be wiped, without causing an increase in size of an apparatus body in the width direction and without damaging a face surface of a recording head.

According to an aspect of the present invention, an inkjet recording apparatus includes a recording head configured to discharge ink to execute recording on a sheet, a conveyance unit configured to convey the sheet, a carriage configured to mount the recording head thereon and to move in a main-scanning direction which is crossing to a sheet conveyance direction, a height change mechanism configured to move the carriage in a height direction, and a control unit configured to control the conveyance unit, the carriage, and the height change mechanism, wherein the control unit moves the carriage in the main-scanning direction to the outside of a sheet conveyance area of the conveyance unit, conveys a cleaning sheet, to which a fold is previously given, to a recording position, causes the height change mechanism to move the carriage to a first height position, moves the carriage to the inside of the sheet conveyance area, causes the height change mechanism to move the carriage to a second height position which is lower than the first height position, and causes the conveyance unit to convey the cleaning sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
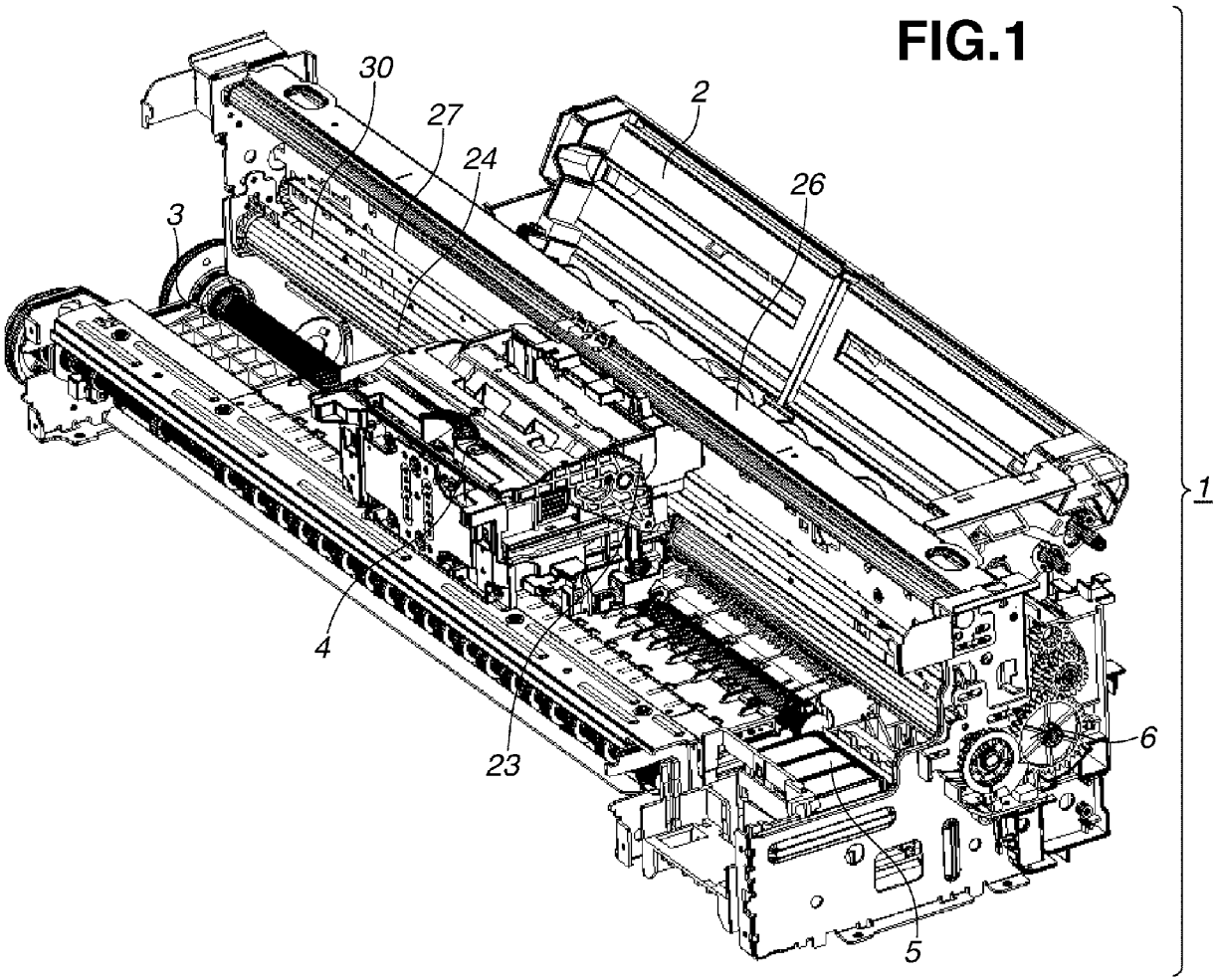
FIG. 1 is a perspective view of an inkjet recording apparatus according to a first exemplary embodiment of the present invention.
Figure 2:
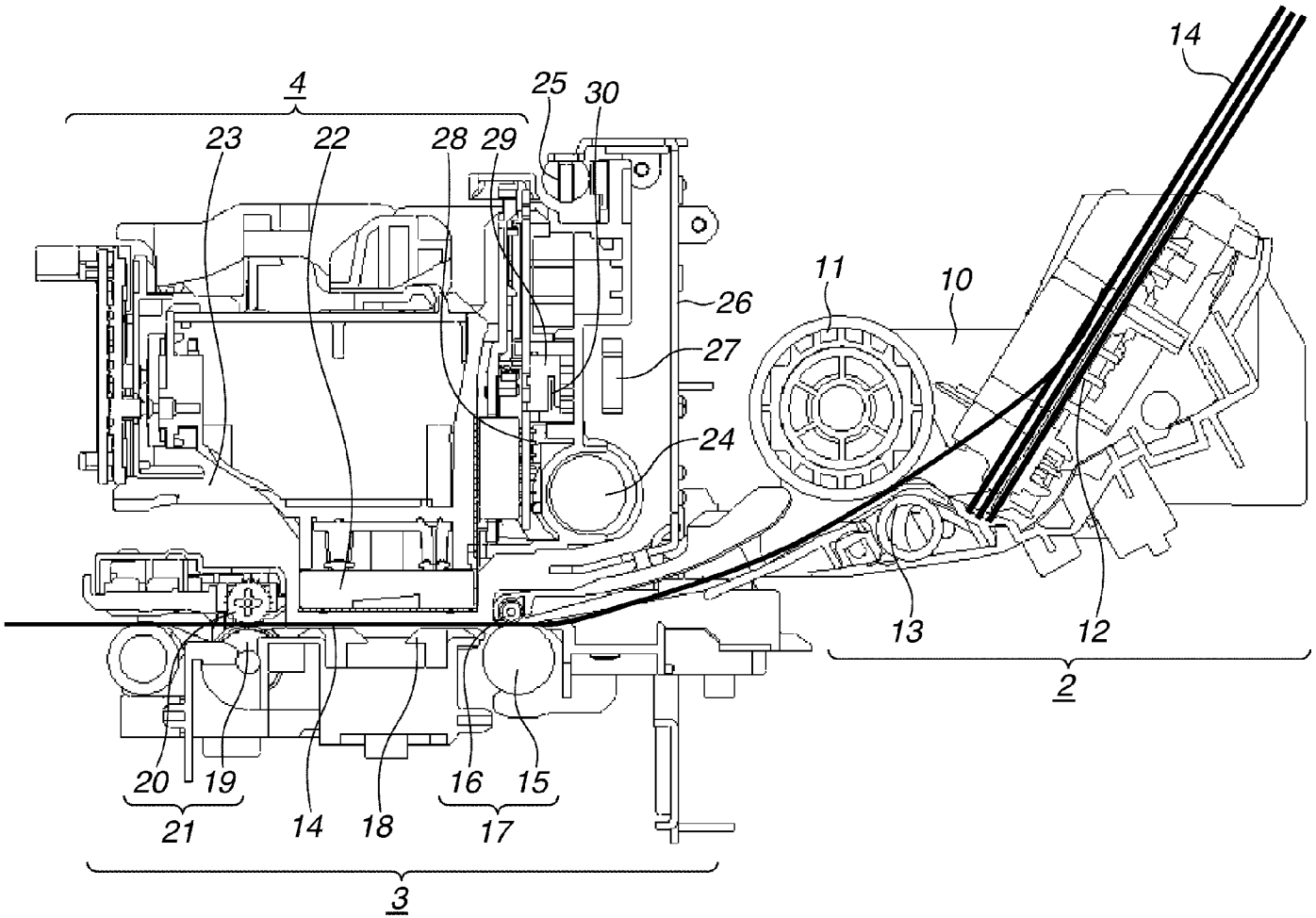
FIG. 2 is a schematic cross section of the inkjet recording apparatus according to the first exemplary embodiment of the present invention.

Hereinafter, a first exemplary embodiment of the present invention will be described in detail with reference to the drawings. FIG. 1 is a perspective view of an inkjet recording apparatus 1 according to the first exemplary embodiment of the present invention. FIG. 2 is a schematic cross section of the inkjet recording apparatus 1 according to the first exemplary embodiment of the present invention. The inkjet recording apparatus 1 includes: a feeding unit 2 feeding a recording sheet 14 as a recording material; a conveyance unit 3 conveying the recording sheet 14; a carriage unit 4 reciprocally movable in a main-scanning direction crossing to a conveyance direction of the recording sheet 14; a cleaning unit 5; and a carriage height change mechanism 6.

First, a schematic configuration of the feeding unit 2 will be described. As illustrated in FIG. 2, the feeding unit 2 includes a feeding frame 10, a feeding roller 11, a pressing plate 12, and a separation roller 13. The feeding roller 11 is movably supported via a shaft by the feeding frame 10. The pressing plate 12 is supported via a shaft by the feeding frame 10 and is configured to be rotatable in the direction in which a top end is brought close to/away from the feeding roller 11. The separation roller 13 is arranged below the feeding roller 11 and downstream of the pressing plate 12. The separation roller 13 is swingable in a direction in which the separation roller 13 is brought close to/away from the feeding roller 11. The feeding roller 11 feeds the top layer portion of the recording sheets 14 placed on the pressing plate 12 and operates in cooperation with the separation roller 13 to feed the recording sheets 14 to the conveyance unit 3 one by one.

Next, a schematic configuration of the conveyance unit 3 will be described with reference to FIGS. 1 and 2. The conveyance unit 3 includes a conveyance roller 15 conveying a recording sheet 14 and a pinch roller 16, which is driven and rotated while in contact with the conveyance roller 15. The conveyance roller 15 and the pinch roller 16 form a conveyance roller pair 17. A platen 18 is arranged downstream of the conveyance roller pair 17. The recording sheet 14 conveyed by the conveyance roller pair 17 is conveyed through the top surface of the platen 18. A discharge roller 19 and a spur 20, which is driven and rotated while in contact with the discharge roller 19, are arranged downstream of the platen 18. The discharge roller 19 and the spur 20 form a discharge roller pair 21. When the leading edge of the recording sheet 14 conveyed by the conveyance roller pair 17 reaches the discharge roller pair 21, the recording sheet 14 is conveyed by the conveyance roller pair 17 and the discharge roller pair 21. Since the conveyance roller 15 and the discharge roller 19 are configured to have approximately the same conveyance speed, the recording sheet 14 can be conveyed accurately.

Next, a schematic configuration of the carriage unit 4 will be described with reference to FIGS. 1 and 2. The carriage unit 4 includes a carriage 23, to which a recording head 22 is detachably attached. The carriage 23 is supported by a carriage shaft 24. A carriage upper shaft 25 holds the upper portion of the carriage 23 and defines the orientation of the carriage 23 with respect to the platen 18. The carriage 23 is supported by the carriage shaft 24 and the carriage upper shaft 25. The carriage 23 is driven by a carriage motor (not illustrated) attached to a chassis member 26 via a timing belt 27 and reciprocally moves along the carriage shaft 24 in a direction (main-scanning direction) crossing to the conveyance direction of the recording sheet 14. A carriage substrate 28 is attached to the carriage 23, and a carriage sensor 29 is mounted on the carriage substrate 28. A linear scale 30 is attached to the chassis member 26. A plurality of lines is printed on the linear scale 30, which is arranged approximately parallel to the timing belt 27. The positions of the carriage 23, the timing belt 27, and the linear scale 30 are adjusted so that the carriage sensor 29 can detect the front side of the linear scale 30 when the carriage 23 moves in the main-scanning direction. The position of the carriage 23 in the main-scanning direction is detected by causing the carriage sensor 29 to detect a plurality of lines printed on the linear scale 30.

Figure 3:
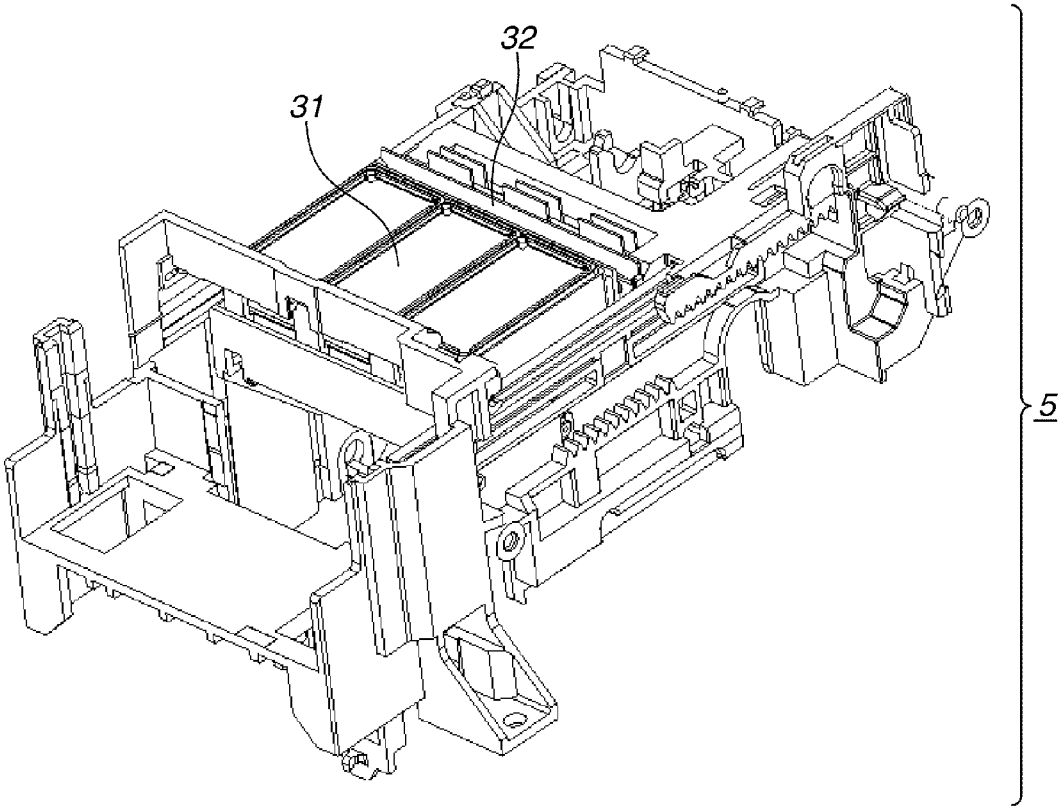
FIG. 3 is a schematic perspective view of a cleaning unit according to the first exemplary embodiment of the present invention.

Next, a schematic configuration of the cleaning unit 5 will be described with reference to FIGS. 1 and 3. FIG. 3 is a schematic perspective view of the cleaning unit 5 according to the first exemplary embodiment of the present invention. As illustrated in FIG. 1, the cleaning unit 5 is arranged outside the recording sheet conveyance area in the main-scanning direction of the apparatus body (in the width direction of the apparatus body). In other words, the cleaning unit 5 is arranged at the right-side end of the apparatus body when seen from the recording sheet discharge side (the front side of the apparatus body). When the carriage unit 4 moves in the main-scanning direction and reaches a cleaning position where the carriage unit 4 faces the cleaning unit 5, the cleaning unit 5 cleans the recording head 22. The cleaning unit 5 includes a cap 31 preventing drying of the nozzles of the recording head 22 and a wiper member 32 cleaning the ink discharging face surface of the recording head 22. The wiper member 32 is configured to move reciprocally in the conveyance direction of the recording sheet 14 (in the sub-scanning direction). The wiper member 32 moves in the sub-scanning direction while in contact with the face surface of the recording head 22. In this way, the wiper member 32 wipes the face surface soiled with ink. In the present exemplary embodiment, the cleaning position approximately corresponds to the right-side limit position of the movable area of the carriage 23. Thus, the carriage 23 cannot move further to the right from the cleaning position.

Figure 4:
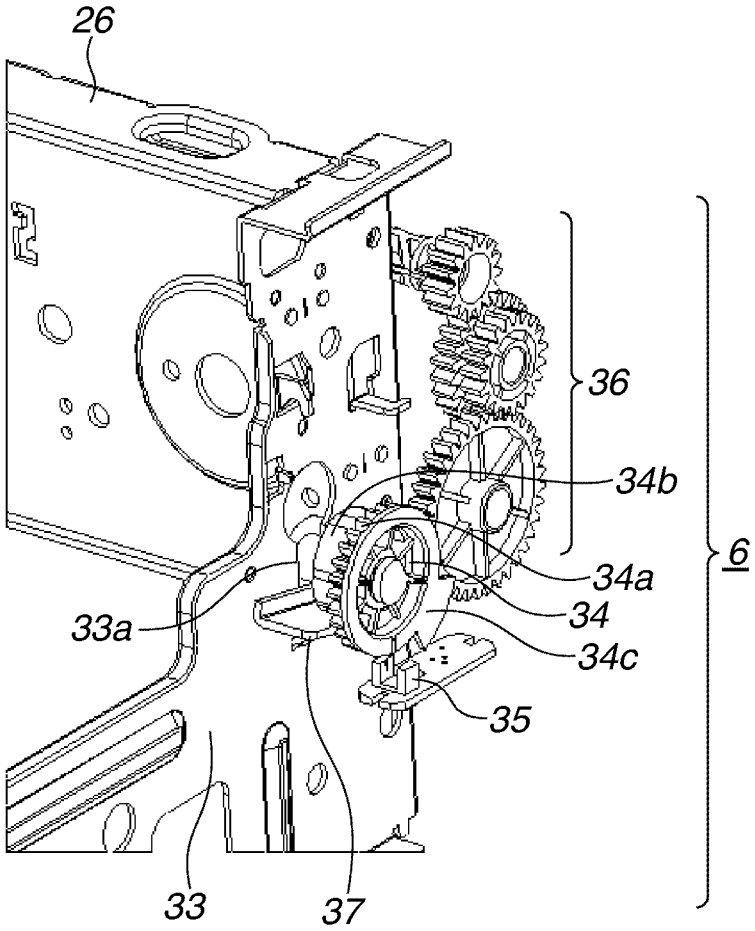
FIG. 4 is a schematic perspective view of a carriage height change mechanism according to the first exemplary embodiment of the present invention.

Next, the carriage height change mechanism 6 will be described with reference to FIGS. 1 and 4. FIG. 4 is a schematic perspective view of the carriage height change mechanism 6 according to the first exemplary embodiment of the present invention. To enable recording on various types of recording sheets 14, the inkjet recording apparatus 1 according to the present exemplary embodiment can change the height of the carriage 23 so that the distance between the recording head 22 and the platen 18 can be changed.

As illustrated in FIG. 1, the carriage height change mechanism 6 is arranged at the right-side end of the apparatus body, seen from the front side of the apparatus body. In addition, as illustrated in FIG. 4, the carriage height change mechanism 6 is attached to the chassis member 26 and a side chassis member 33. In addition, the carriage height change mechanism 6 includes a carriage shaft cam 34 and a carriage shaft cam sensor 35. The carriage shaft cam 34 is attached to an end of the carriage shaft 24 and includes a gear portion **34*a*. The gear portion 34*a* engages with a carriage-height-change gear line 36 connected to a carriage-height drive motor (not illustrated). In addition, the carriage shaft cam 34 includes a cam portion 34*b*, which contacts a carriage-height adjustment plate 37. The side chassis member 33 has a hole portion 33*a* through which the carriage shaft 24** runs. The carriage shaft 24 is fitted with the hole portion 33*a* with respect to the conveyance direction of the recording sheet 14. In addition, the hole portion 33*a* has an elongated-shape hole with the longer diameter in the vertical direction in FIG. 4, so that the carriage shaft 24 can move in the vertical direction. Thus, when the carriage shaft cam 34 is rotated and the surface of contact between the cam portion 34*b* and the carriage-height adjustment plate 37 is moved, the carriage shaft 24 inserted in the carriage shaft cam 34 is moved in the vertical direction. In addition, the carriage shaft cam 34 includes a sensor detection portion 34*c*. When the carriage shaft cam 34 is rotated, the carriage shaft cam sensor 35 detects the sensor detection portion 34*c* at a predetermined rotation position. By causing the carriage shaft cam sensor 35 to detect the sensor detection portion 34*c*, the recording apparatus 1 detects the rotation reference position of the cam portion 34*b* of the carriage shaft cam 34. By controlling the drive amount of the carriage-height drive motor from the rotation reference position, the cam portion 34*b* is moved to a predetermined rotation position and the carriage shaft 24 is moved to a predetermined height.

Figure 5:
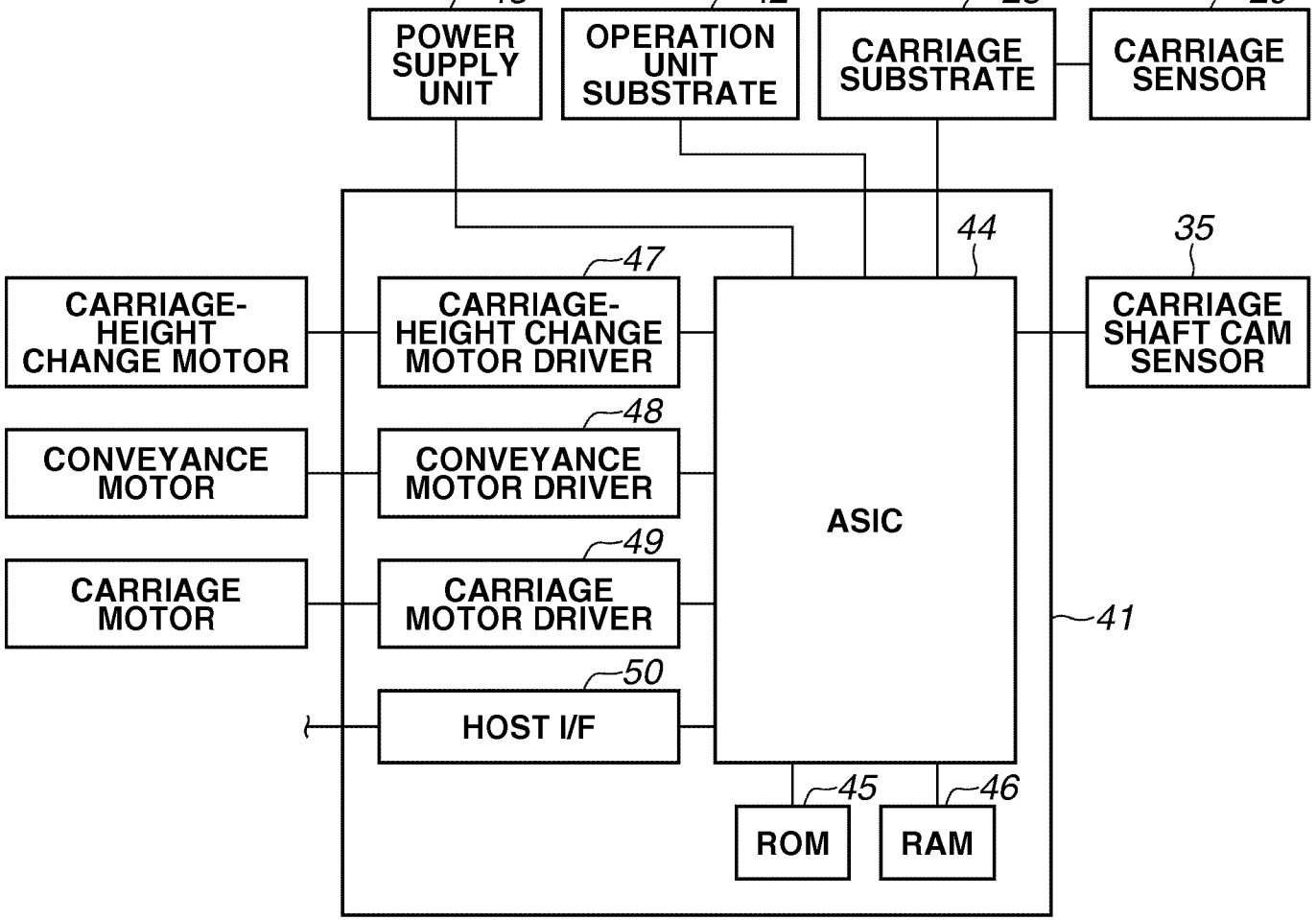
FIG. 5 is a block diagram of a control system according to the first exemplary embodiment of the present invention.

Next, a configuration of a control system will be described with reference to FIG. 5. FIG. 5 is a block diagram of the control system according to the first exemplary embodiment of the present invention.

The control system includes a main control substrate 41, an operation unit substrate 42, a carriage substrate 28, and a power supply unit 43. The operation unit substrate 42 is arranged on the exterior of the apparatus body (not illustrated) and includes a switch and a light-emitting diode (LED) connected to a display unit and an operation button. In addition, as described above, the carriage substrate 28 is attached to the carriage 23 and controls an ink droplet discharge operation of the recording head 22, based on a command from the main control substrate 41. In addition, as described above, the carriage sensor 29 is mounted on the carriage substrate 28.

The main control substrate 41 includes an application specific integrated circuit (ASIC) 44, a read-only memory (ROM) 45, a random access memory (RAM) 46, a carriage-height change motor driver 47, a conveyance motor driver 48, a carriage motor driver 49, and a host interface (I/F) 50. The ASIC 44 executes various types of control operations based on programs stored in the ROM 45. The RAM 46 temporarily stores various types of data. The motor drivers 47 to 49 control driving of a carriage-height change motor, a conveyance motor, and a carriage motor, respectively. In addition, the motor drivers 47 to 49 are configured to drive the carriage height change mechanism 6, the conveyance roller 15 and the discharge roller 19, and the carriage 23, respectively, based on the driving of the motors. In addition, the motor drivers 47 to 49 are configured to control a recording operation based on received data, such as a recording command from a host computer (not illustrated) connected to the host I/F 50. The ASIC 44 is supplied with signals from the carriage sensor 29 and the carriage shaft cam sensor 35. Based on the signals from the sensors, the ASIC 44 causes the motor drivers 47 to 49 to control driving of the respective motors, to control a recording operation, various maintenance operations, and an operation of displaying information on a display unit, for example.

Figure 6:
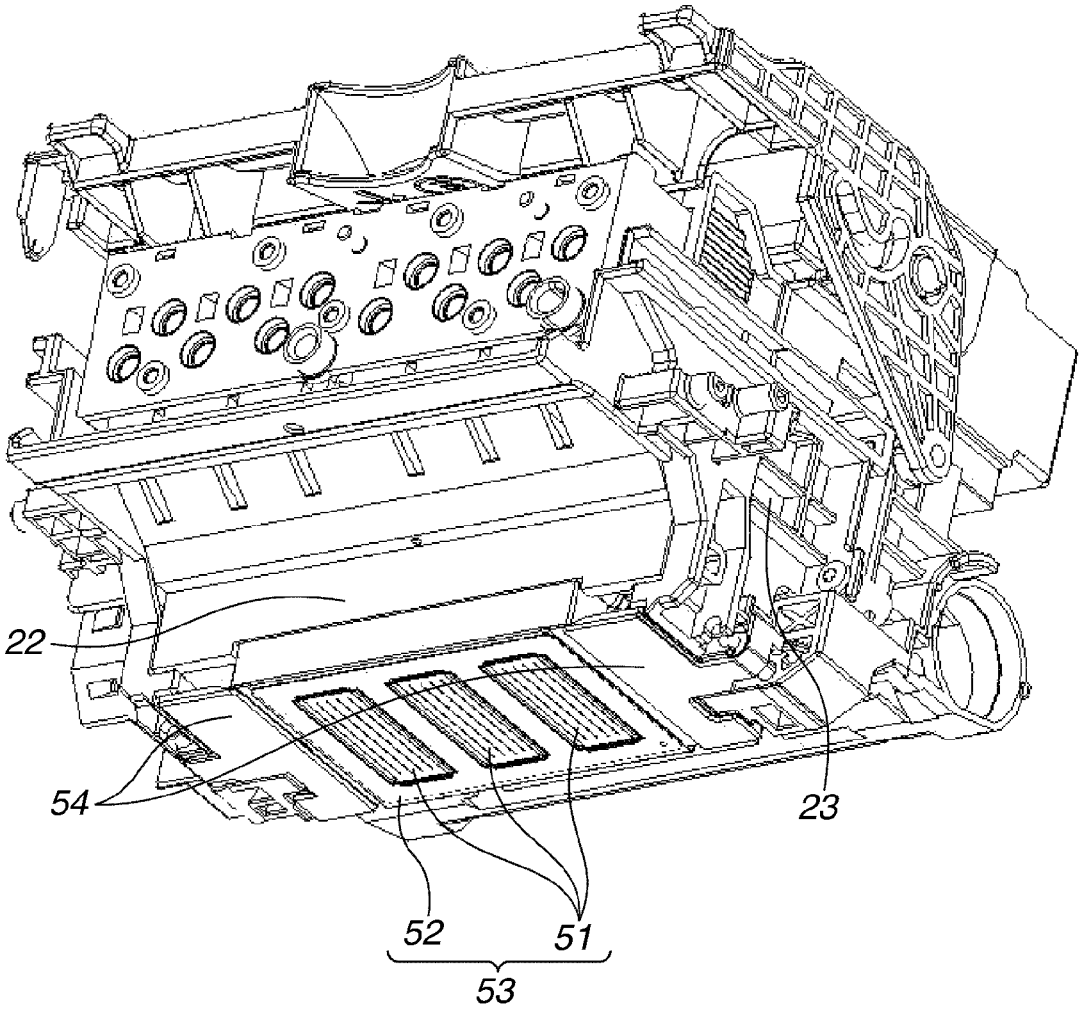
FIG. 6 is a perspective view of a carriage unit according to the first exemplary embodiment of the present invention, seen from the ink discharge surface side.

FIG. 6 is a perspective view of the carriage unit 4 according to the first exemplary embodiment of the present invention, seen from the ink discharge surface side of the recording head 22. As illustrated in FIG. 6, the recording head 22 includes nozzle surfaces 51 that include nozzles to discharge ink and that are formed by heater boards, and a flexible printed circuit board (FPC) 52 transmitting electrical signals from the carriage substrate 28 to heaters on the heater boards. The nozzle surfaces 51 and the FPC 52 form a face surface 53. Since the FPC 52 is fixed to the recording head 22 by adhesion, ends of the FPC 52 can be peeled easily. Thus, when a paper jam is caused, if an end of the FPC 52 is caught by the recording sheet 14, the FPC 52 may be peeled. As a result, the recording head 22 may be broken down. To prevent such peeling of the FPC 52, a head protection portion 54 is arranged on either side of the face surface 53 in the main-scanning direction.

Figure 7:
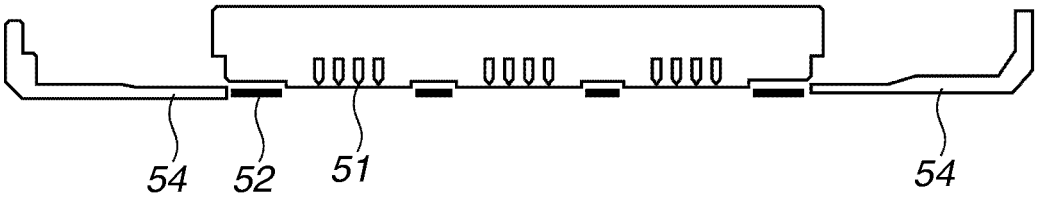
FIG. 7 is a schematic cross section of the carriage unit according to the first exemplary embodiment of the present invention, seen from the apparatus front side.

FIG. 7 is a schematic cross section of the carriage unit 4 according to the first exemplary embodiment of the present invention, seen from the front side of the apparatus. As illustrated in FIG. 7, the head protection portions 54 are arranged lower than the nozzle surfaces 51 and approximately even with the FPC 52. In this way, the recording sheet 14 does not contact the nozzle surfaces 51 or affect the ink discharge operation.

Thus, by arranging the head protection portions 54 near the face surface 53 of the recording head 22, breakdown of the recording head 22 due to peeling of an end of FPC 52 is prevented. However, since the head protection portions 54 are arranged near the face surface 53, ink mist may be attached to the head protection portions 54.

Figure 8:
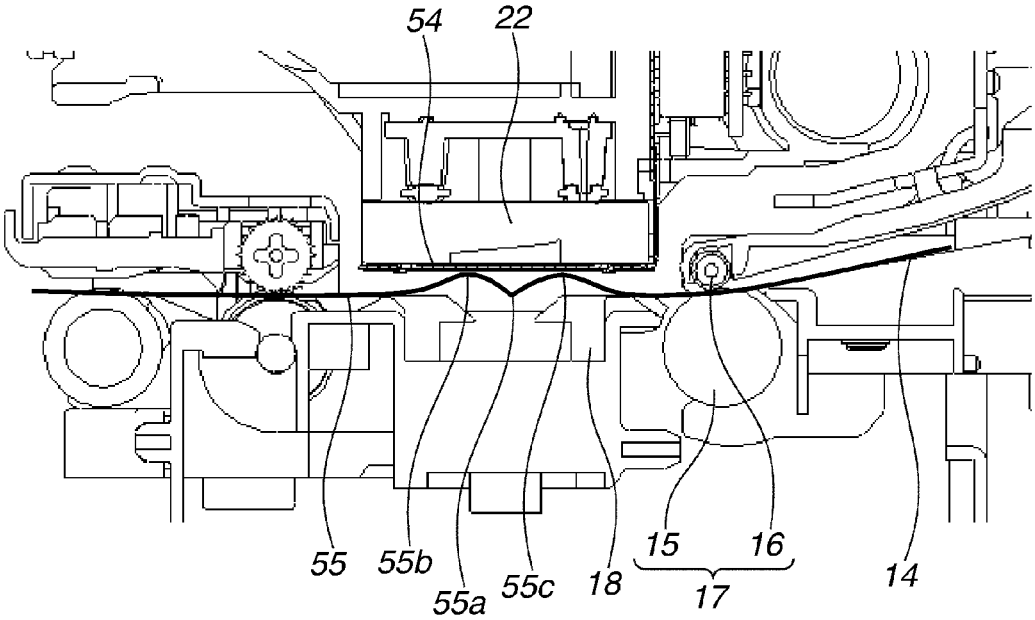
FIG. 8 is a cross section of a curved recording material cleaning head protection portions according to the first exemplary embodiment of the present invention.

Next, a method for cleaning the head protection portions 54 according to the first exemplary embodiment of the present invention will be described with reference to FIG. 8. FIG. 8 is a cross section illustrating a curved recording material cleaning the head protection portions 54 according to the first exemplary embodiment. In the present exemplary embodiment, to clean the head protection portions 54, a cleaning sheet 55, to which a fold 55*a* is previously given, is used. The cleaning sheet 55 has a valley fold 55*a* in the width direction crossing to the conveyance direction. When the fold 55*a* of the cleaning sheet 55 is conveyed to a position above the top of the platen 18, curved portions 55*b* and 55*c* that slightly float from the platen surface are formed downstream and upstream of the fold 55*a* in the conveyance direction.

The curved portions 55*b* and 55*c* are elastically curved upwards and are formed to be depressed if slightly pressed from above. The cleaning sheet 55 is conveyed while the curved portions 55*b* and 55*c* slightly contact the head protection portions 54. In this way, ink attached to the head protection portions 54 is transferred onto the curved portions 55*b* and 55*c*, and, as a result, the head protection portions 54 are cleaned.

Since the elastic force of the curved portions 55*b* and 55*c* is small, the head protection portions 54 and the face surface 53 are not damaged while the ink is transferred. In addition, as described above, the nozzle surfaces 51 are arranged higher than the head protection portions 54. Thus, when the cleaning sheet 55 cleans the head protection portions 54, the cleaning sheet 55 does not contact the nozzle surfaces 51.

Thus, based on the method for cleaning the head protection portions 54 according to the first exemplary embodiment, the cleaning sheet 55 to which the fold 55*a* is previously given is conveyed, and the curved portions 55*b* and 55*c* formed downstream and upstream of the fold 55*a* are conveyed to contact the head protection portions 54, to clean the head protection portions 54.

Figure 9:
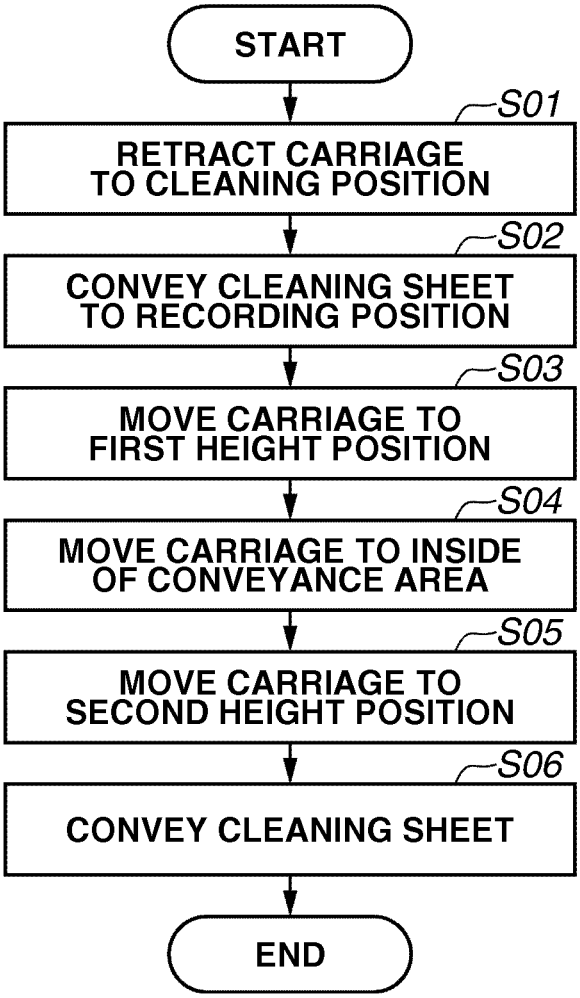
FIG. 9 is a flow chart illustrating a method for cleaning the head protection portions according to the first exemplary embodiment of the present invention.

Next, an operation of cleaning the head protection portions 54 according to the first exemplary embodiment of the present invention will be described with reference to FIG. 9. FIG. 9 is a flow chart of a method for cleaning the head protection portions 54 according to the first exemplary embodiment.

First, in step S01, the carriage 23 is retracted to the cleaning position, which is located outside the sheet conveyance area in the main-scanning direction. In step S01, the carriage 23 is at a recording height position at which the recording head 22 executes recording on a recording sheet. Next, in step S02, the cleaning sheet 55 to which the fold 55*a* is previously given is conveyed by the conveyance roller pair 17, and the leading edge of the cleaning sheet 55 in the conveyance direction is conveyed to the discharge roller pair 21. Consequently, the cleaning sheet 55 is accurately conveyed to the recording position where the recording head 22 executes recording on a sheet. Next, in step S03, the carriage height change mechanism 6 lifts the face surface 53 and the head protection portions 54 to a height (a first height position) where the face surface 53 and the head protection portions 54 do not contact the cleaning sheet 55. The first height position is higher than the recording height position.

Next, in step S04, the carriage 23 is moved in the main-scanning direction to the inside of the sheet conveyance area. In step S04, the carriage 23 is moved so that the face surface 53 does not face a width-direction end of the cleaning sheet 55, based on detection results from the carriage sensor 29. Next, in step S05, the carriage height change mechanism 6 lowers the carriage 23 to a height (a second height position) where the head protection portions 54 contact the curved portions 55*b* and 55*c* of the cleaning sheet 55. The second height position is lower than the first height position. The second height position may be the same as the recording height position.

Next, in step S06, the conveyance roller pair 17 and the discharge roller pair 21 convey the cleaning sheet 55 including the curved portions 55*b* and 55*c* downstream and upstream of the fold 55*a*. In step S06, the cleaning sheet 55 is conveyed while the curved portions 55*b* and 55*c* slightly contact the head protection portions 54. In this way, the cleaning sheet 55 wipes the ink attached to the head protection portions 54. In step S06, for better cleaning effects, the conveyance motor may be rotated in the normal and reverse directions to move the cleaning sheet 55 reciprocally back and force. When the cleaning sheet 55 is discharged to the outside of the apparatus by the discharge roller pair 21, the operation of cleaning the head protection portions 54 is completed.

If the cleaning sheet 55 to which the fold 55*a* is previously given is fed from the feeding unit 2 after the carriage 23 is moved to the inside of the sheet conveyance area, the leading edge of the cleaning sheet 55 may contact the carriage unit 4. As a result, for example, a paper jam may be caused. Even if the carriage 23 is at the second height position, for example, a paper jam may be caused. Thus, in the first exemplary embodiment, after the carriage 23 is retracted to the cleaning position, the cleaning sheet 55 is fed from the feeding unit 2.

As described above, the method for cleaning the carriage 23 according to the first exemplary embodiment includes retracting the carriage 23 to the cleaning position, conveying the cleaning sheet 55 to which the fold 55*a* is previously given to the recording position, lifting the carriage 23 to the height (the first height position) where the face surface 53 and the head protection portions 54 do not contact the curved cleaning sheet 55, moving the carriage 23 to the inside of the sheet conveyance area, lowering the carriage 23 to the height (the second height position) where the head protection portions 54 contact the curved portions 55*b* and 55*c* of the cleaning sheet 55, and conveying the cleaning sheet 55 while the curved portions 55*b* and 55*c* of the cleaning sheet 55 slightly contact the head protection portions 54. In this way, the cleaning sheet 55 cleans the head protection portions 54 soiled with ink.

According to the present exemplary embodiment, the wiper member 32 does not clean the head protection portions 54. Thus, to clean the head protection portion 54 arranged further from the wiper member 32, the size of the apparatus body does not need to be increased in the width direction. In addition, specifications regarding the durability of the wiper member 32 do not need to be improved.

Figure 10:
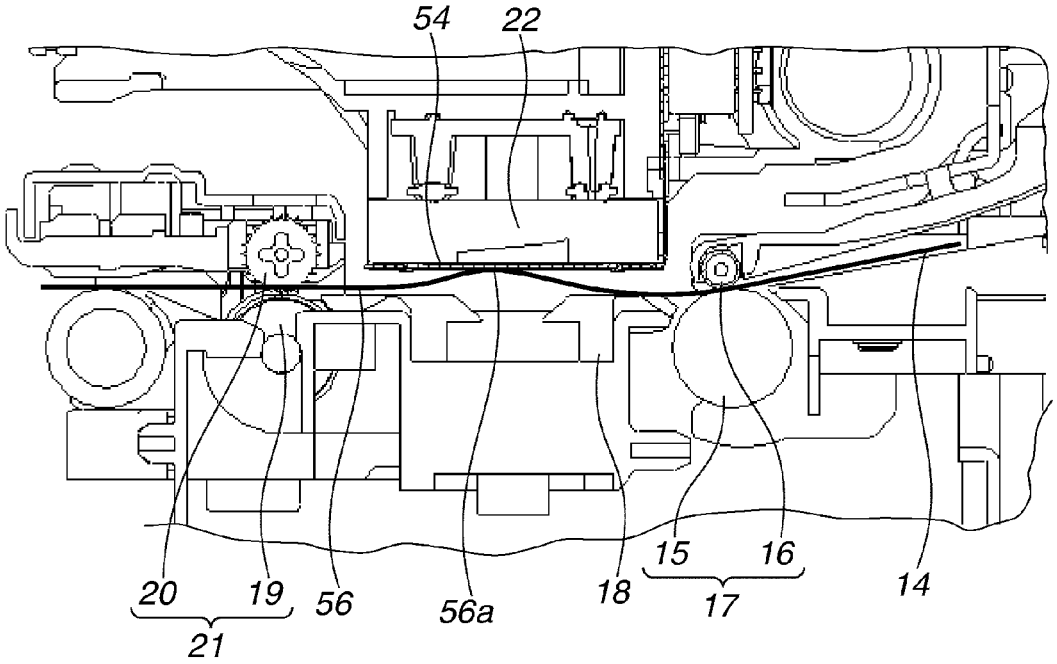
FIG. 10 is a schematic cross section of an inkjet recording apparatus according to a second exemplary embodiment of the present invention.
Figure 11:
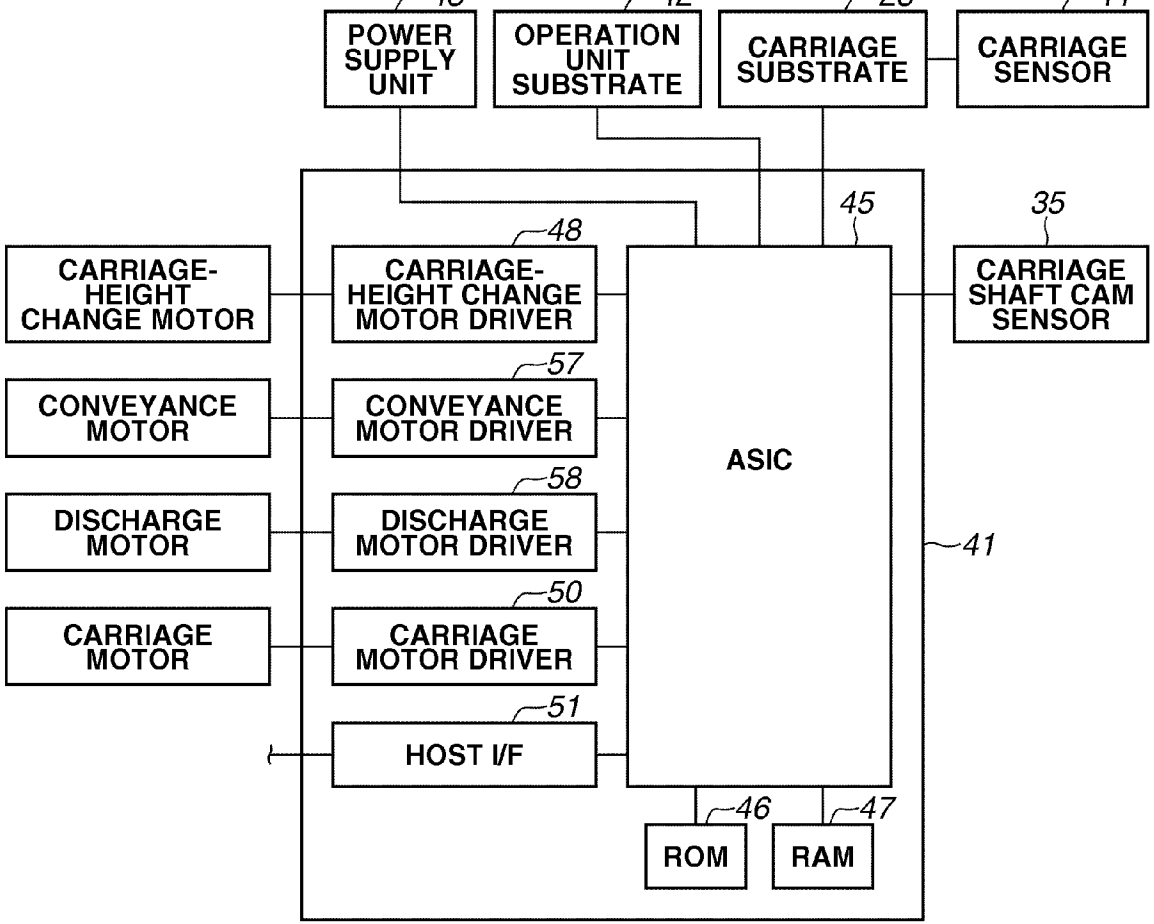
FIG. 11 is a block diagram illustrating a control system according to the second exemplary embodiment of the present invention.

Next, a second exemplary embodiment of the present invention will be described. In the first exemplary embodiment, the cleaning sheet 55 to which the fold 55*a* is previously given is fed. Namely, the curved portions 55*b* and 55*c* are originally formed. However, in the second exemplary embodiment, after a cleaning sheet without a fold is fed, a curved portion is formed by the apparatus body. FIG. 10 is a schematic cross section of an inkjet recording apparatus 1 according to the second exemplary embodiment of the present invention. FIG. 11 is a block diagram illustrating a control system according to the second exemplary embodiment of the present invention.

As illustrated in FIG. 11, the control system according to the second exemplary embodiment separately includes a conveyance motor driving the conveyance roller 15 and a discharge motor driving the discharge roller 19. In addition, the control system according to the second exemplary embodiment includes a conveyance motor driver 57 controlling driving of the conveyance motor and a discharge motor driver 58 controlling driving of the discharge motor.

In FIG. 10, a cleaning sheet 56 without a fold is conveyed until pinched by the conveyance roller pair 17 and the discharge roller pair 21. Next, the discharge roller 19 is stopped, and the conveyance roller 15 is rotated in a normal direction (in the direction in which the recording sheet 14 is conveyed). As a result, a curved portion 56*a* is formed in the cleaning sheet 56. After the curved portion 56*a* is formed, the conveyance roller 15 and the discharge roller 19 are rotated at the same conveyance speed. Namely, the cleaning sheet 56 is conveyed while the curved portion 56*a* slightly contacts the head protection portions 54. In this way, the curved portion 56*a* can wipe ink attached to the head protection portions 54.

Figure 12:
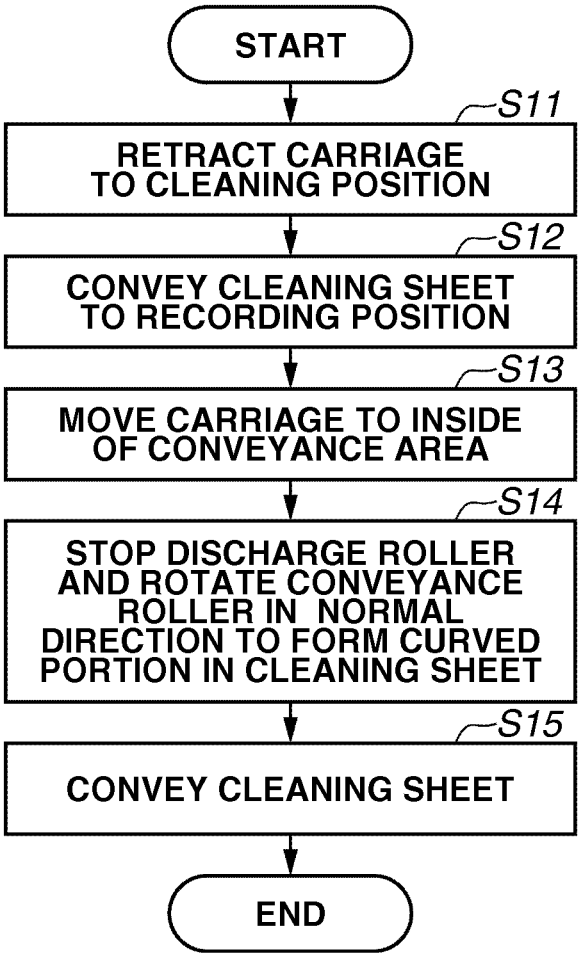
FIG. 12 is a flow chart illustrating a method for cleaning the head protection portions according to the second exemplary embodiment of the present invention.

Next, an operation of cleaning the head protection portions 54 according to the second exemplary embodiment of the present invention will be described with reference to FIG. 12. FIG. 12 is a flow chart illustrating a method for cleaning the head protection portions 54 according to the second exemplary embodiment. First, in step S11, the carriage 23 is retracted to the cleaning position, which is located outside the sheet conveyance area in the main-scanning direction. In step S11, the carriage 23 is at a recording height position at which the recording head 22 executes recording on a recording sheet. Next, in step S12, the conveyance roller pair 17 conveys the cleaning sheet 56 to the recording position where the leading edge of the cleaning sheet 56 accurately reaches the discharge roller pair 21. Next, in step S13, the carriage 23 is moved in the main-scanning direction to the inside of the sheet conveyance area. In step S13, the carriage 23 is moved so that the face surface 53 does not face a width-direction end of the cleaning sheet 56, based on detection results from the carriage sensor 29. The carriage 23 is maintained at the recording height position.

Next, in step S14, the discharge roller 19 is stopped, and the conveyance roller 15 is rotated in a normal direction to form the curved portion 56*a* in the cleaning sheet 56. The curved portion 56*a* is formed to slightly contact the head protection portions 54. Next, in step S15, the conveyance roller pair 17 and the discharge roller pair 21 convey the curved cleaning sheet 56. In step S15, the cleaning sheet 56 is conveyed while the curved portion 56*a* slightly contacts the head protection portions 54. In this way, the cleaning sheet 56 wipes ink attached to the head protection portions 54. When the cleaning sheet 56 is discharged to the outside of the apparatus by the discharge roller pair 21, the operation of cleaning the head protection portions 54 is completed.

To form the curved portion 56*a* in the cleaning sheet 56, the discharge roller 19 may be rotated in the reverse direction while the conveyance roller 15 is stopped. Alternatively, the conveyance roller 15 and the discharge roller 19 may be rotated in the normal and reverse directions, respectively.

As described above, based on the method for cleaning the carriage 23 according to the second exemplary embodiment, the conveyance roller 15 and the discharge roller 19 are driven separately, and at least one of the rotation direction and the conveyance speed of the conveyance roller 15 and the discharge roller 19 is controlled. In this way, the curved portion 56*a* is formed in the cleaning sheet 56. By conveying the cleaning sheet 56 while the curved portion 56*a* slightly contacts the head protection portions 54, the cleaning sheet 56 wipes ink attached to the head protection portions 54. According to the second exemplary embodiment, the size of the apparatus body does not need to be increased in the width direction. In addition, specifications regarding the durability of the wiper member 32 do not need to be improved. In addition, according to the present exemplary embodiment, since a fold does not need to be previously given to the cleaning sheet 56, a normal recording sheet can be used as the cleaning sheet 56.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-230663 filed Oct. 20, 2011, which is hereby incorporated by reference herein in its entirety.

What is claimed is:

1. An inkjet recording apparatus comprising:

a recording head configured to discharge ink to execute recording on a sheet;

a conveyance unit configured to convey the sheet;

a carriage configured to mount the recording head thereon and to move in a main-scanning direction which is crossing to a sheet conveyance direction;

a height change mechanism configured to move the carriage in a height direction; and a control unit configured to control the conveyance unit, the carriage, and the height change mechanism, wherein the control unit moves the carriage in the main-scanning direction to the outside of a sheet conveyance area of the conveyance unit, conveys a cleaning sheet, to which a fold is previously given, to a recording position, causes the height change mechanism to move the carriage to a first height position, moves the carriage to the inside of the sheet conveyance area, causes the height change mechanism to move the carriage to a second height position which is lower than the first height position, and causes the conveyance unit to convey the cleaning sheet.

2. The inkjet recording apparatus according to claim 1, wherein the first height position is higher than a recording height position at which the recording head executes recording on the sheet.

3. The inkjet recording apparatus according to claim 2, wherein the second height position is the same as the recording height position.

4. The inkjet recording apparatus according to claim 1, wherein, when the carriage is at the second height position, the cleaning sheet contacts the carriage.

5. The inkjet recording apparatus according to claim 4, wherein the cleaning sheet includes curved portions formed downstream and upstream of the fold, and wherein the curved portions contact the carriage.

6. The inkjet recording apparatus according to claim 5, wherein the recording head includes a nozzle surface on which a nozzle to discharge ink is formed, wherein the carriage includes a head protection portion arranged near and lower than the nozzle surface, and wherein the curved portions contact the head protection portion.

7. The inkjet recording apparatus according to claim 6, wherein the curved portions do not contact the nozzle surface.

8. A method for cleaning a carriage of an inkjet recording apparatus including a recording head configured to discharge ink to execute recording on a sheet, a conveyance unit configured to convey the sheet, the carriage configured to mount the recording head thereon and to move in a main-scanning direction which is crossing to a sheet conveyance direction, and a height change mechanism configured to move the carriage in a height direction, the method comprising:

moving the carriage in the main-scanning direction to the outside of a sheet conveyance area of the conveyance unit;

conveying a cleaning sheet, to which a fold is previously given, to a recording position;

moving the carriage to a first height position via the height change mechanism;

moving the carriage to the inside of the sheet conveyance area;

moving the carriage to a second height position via the height change mechanism; and conveying the cleaning sheet via the conveyance unit.

9. An inkjet recording apparatus comprising:

a recording head configured to discharge ink to execute recording on a sheet;

a conveyance unit arranged upstream of the recording head and configured to convey the sheet;

a discharge unit arranged downstream of the recording head and configured to convey the sheet;

a carriage configured to mount the recording head thereon and to move in a main-scanning direction which is crossing to a sheet conveyance direction; and a control unit configured to control the conveyance unit, the discharge unit, and the carriage, wherein the control unit causes the conveyance unit to convey a cleaning sheet to a recording position, controls driving of the conveyance unit and the discharge unit to form a curved portion in the cleaning sheet, and causes the conveyance unit and the discharge unit to convey the cleaning sheet while the curved portion contacts the carriage.

* * * * *